United States Patent [19]

Trappler

[11] Patent Number: 4,597,188

[45] Date of Patent: Jul. 1, 1986

[54] FREEZE DRY PROCESS AND STRUCTURE

[76] Inventor: Edward H. Trappler, 1015 Avenue D, Parkland, Pa. 19047

[21] Appl. No.: 707,685

[22] Filed: Mar. 4, 1985

[51] Int. Cl.[4] ..... F26B 5/06; F26B 3/00; F26B 13/30

[52] U.S. Cl. ..... 34/5; 34/36; 34/92

[58] Field of Search ..... 34/5, 92, 36

[56] References Cited

U.S. PATENT DOCUMENTS

| | | | |
|---|---|---|---|
| 3,192,643 | 7/1965 | Rieutord | 35/5 |
| 3,269,025 | 8/1966 | Dryden et al. | 34/5 |
| 3,381,746 | 5/1968 | Wiegmann et al. | 165/11 R |
| 3,384,978 | 5/1968 | Cox | 34/5 |
| 3,672,068 | 6/1972 | Wilkison | 34/15 |
| 3,795,986 | 3/1974 | Sutherland et al. | 34/92 |
| 4,033,048 | 7/1977 | Van Ike | 34/92 |
| 4,178,697 | 12/1979 | Sutherland | 34/92 |

*Primary Examiner*—John J. Camby

*Attorney, Agent, or Firm*—Ferrill and Logan

[57] ABSTRACT

A vacuum-chamber, batch-process, freeze dryer system, of the type usable for pharmaceutical, diagnostic and chemical processing applications, incorporates extensive regulation of a carrier gas injected in minute quantities into an evacuated vacuum chamber and a distribution system which regulates a more even flow over each of a plurality of material holding containers held within the evacuated vacuum chamber of the carrier gas.

18 Claims, 10 Drawing Figures

FREEZE DRY PROCESS AND STRUCTURE

BACKGROUND OF THE INVENTION

This invention relates to a lyophilization process and the apparatus used for such a process. Moreover, it relates to the construction of a structure within which a freeze dry (lyophilization) process is carried out in a batch method and under precise control necessary for quality required by the pharmaceutical, research and development and related industries.

When process results must be exacting and when process control is important, such as in the chemical and pharmaceutical industry, including the research and development aspects thereof, freeze dry processes have been carried out in small chambers on a batch basis. This allows the operator to more precisely control what occurs to the product or substance being sublimed (freeze dried) than with continuous or spray operations. Typically, a plurality of beakers or containers are held on shelves in a small vacuum chamber.

Weigmann, in U.S. Pat. No. 3,381,746 shows a vapor condensing apparatus having a hollow housing adapted to be excavated to sub-atmospheric pressure. The apparatus includes a tubular refrigerated condenser spaced from the housing and which forms through a connection to the housing a condensating chamber therefor. The condenser construction provides for a counter flow of vapor from a central inlet over the inner surface of a tubular refrigerated condenser unit and then in the opposite direction along the outer surface of the condenser unit to an outlet thereby insuring maximum extraction of the condensibles from the vapor.

Wilkinson, U.S. Pat. No. 3,672,068, shows a method and apparatus for drying materials where the materials to be dried are placed within a container having a plurality of manifold tubes having holes and extending across the chamber formed within the container. The chamber is filled with material to be evacuated so that this material such as grain, cotton, peat or other related material can be dried. The material surrounds the tubes. The chamber is evacuated when a vacuum is created in the manifold tubes.

Sutherland et al, U.S. Pat. No. 3,795,986, show a modular compartment sublimator for freeze drying various materials such as pharmaceuticals. Sutherland et al discusses the major disadvantages of chamber type freeze dryers and their inflexibility and lack of economy when used for subliming pharmaceuticals. Sutherland has stated what has been accepted by the industry, that the use of a single chamber having several shelves does not permit sublimation of diverse materials for products requiring different length drying times. Sutherland further states that the disadvantage of such chamber type freeze dryer pharmaceutical application is that there is an uneven processing of the products to be freeze dried depending upon its location in the single chamber. To overcome this, Sutherland proposes a sublimation chamber having a plurality of small compartments each acting as an independent sublimation chamber. His solution to the uneven processing problem is to provide a modular type design for his chamber.

Silke, U.S. Pat. No. 4,033,048, shows a freeze drying apparatus having a separate condensing chamber connected to an evaporating chamber by means of extraction pipes. The apparatus is intended for use with a liquid which is spray dried within the evacuated evaporation chamber.

Sutherland, U.S. Pat. No. 4,178,697, shows a condensation chamber for freeze drying bulk materials. A cylindrical vacuum evacuated, evaporation chamber, which is intended to be packed with bulk materials, is connected to a single small tubular evacuation duct which extends along the center line and the entire length of the evacuated evaporation chamber. The chamber is surrounded by a plurality of refrigerant coils so that its outer walls are constantly kept cool. The tubular evacuation duct has a principal opening at a first end of the evaporation chamber and four side openings or holes at the opposite end of the chamber. A baffle is utilized to adjust flow to promote a more even evacuation from both ends of the cylindrical chamber. A large centrally located duct opens onto the center of the chamber and is used to carry air into the condensation evacuated evaporation chamber and over the material packed within the chamber in bulk form.

None of the above apparatus are particularly advantageous in freeze drying materials which are typically processed in batch form in small individual quantities held in individual containers or beakers.

The Hull Corporation of Hatboro, Pa. has made commercially available a freeze dry system having an evacuated evaporation chamber and a condensation chamber adjacent thereto and connected through a single large vacuum duct. Contained in the condensation chamber is a plurality of refrigeration coils through which refrigeration fluid is passed.

A temperature controlled heat transfer fluid used to initially freeze the product is circulated through hollow shelves. This heat transfer fluid is then tempered with heat to replace heat loss due to evaporative cooling when the chamber is evacuated and sublimation occurs. A plurality of product containing bottles or trays are placed in single layers on the plurality of temperature controlled shelves. To aid sublimation and increase heat transfer from the heated shelf to the product container via convection, a small amount of an inert gas is allowed to "leak" through the front door, i.e. the product loading door, of the evaporation chamber. This large, single chamber structure has the disadvantages of uneven processing at various locations within the chamber discussed by Sutherland et al, but has advantages over the other above cited art in that the introduction of an inert gas aids in reducing the partial pressure of the evaporation vapor above each beaker held within the evacuated evaporation chamber.

The introduction of carrier gas into the evacuated vacuum evaporation chamber creates a flow over the product which tends to carry off the vapors evaporating from the product and thereby reduce the vapor partial pressure above the product inducing faster sublimation. This process, however, very often comes with mixed results as the volume and therefore the pressure of the carrier gas introduced into the evacuated evaporation chamber is often very hard to control at a constant flow rate and pressure. Moreover, as the most common structure for this freeze dried apparatus has a single large vacuum duct centrally located at the back of the evacuated evaporation chamber and as the carrier gas is introduced at a single point into the chamber, the introduction of the carrier gas very often increases the uneven processing of product depending upon the products location within the single chamber, i.e. on the shelves therein.

The objects of the present invention are intended to improve the process and the structure for carrying out the process for the batch lyophilization of pharmaceutical, laboratory and research and development samples, which samples are held in small quantities in a plurality of beakers or other open containers in a large vacuum evacuated evaporation housing. A further object is to provide an improved distribution of carrier gas flow over each one of the plurality of sample containing beakers. Another object is to achieve improved control of carrier gas pressure and volumetric rate.

SUMMARY OF THE INVENTION

The objects of this invention are realized in a batch process freeze dryer system having a product chamber containing a plurality of open shelves for holding beakers or other open top containers of product samples. This product chamber is connected to a dispirate, condensation chamber through a large duct and evacuated thereinto under the influence of vacuum creating apparatus connected to that condensation chamber.

A supply of inert gas is introduced into the product chamber on a side away from the large evacuation duct. This gas is directed through a distribution system to pass over each of the open shelves and thereby promote a flow to carry off the vapors evaporating from product which would be held in open containers on the shelves. The flow of this carrier gas above a beaker creates a reduction in the sublimation vapor partial pressure and thereby increases the rate of drying of the product.

The distribution of the carrier gas about the product chamber and its collection when ladened with evaporation vapors, as well as, the precise control of the volumetric flow rate of the carrier gas are controlled by the operation of a pressure regulation control system and distribution manifold piping which act together to assure even flow above each row of beakers on each shelf of the product chamber. The distribution manifold piping is tuned so that the back pressures created by the piping structures are equalized at each distribution point.

DESCRIPTION OF THE DRAWINGS

The features, advantages and operation of the invention will be understood from a reading of the following detailed description of the invention in conjunction with the accompanying drawings in which like numerals refer to like elements and in which.

DETAILED DESCRIPTION OF THE INVENTION

Figure 1:
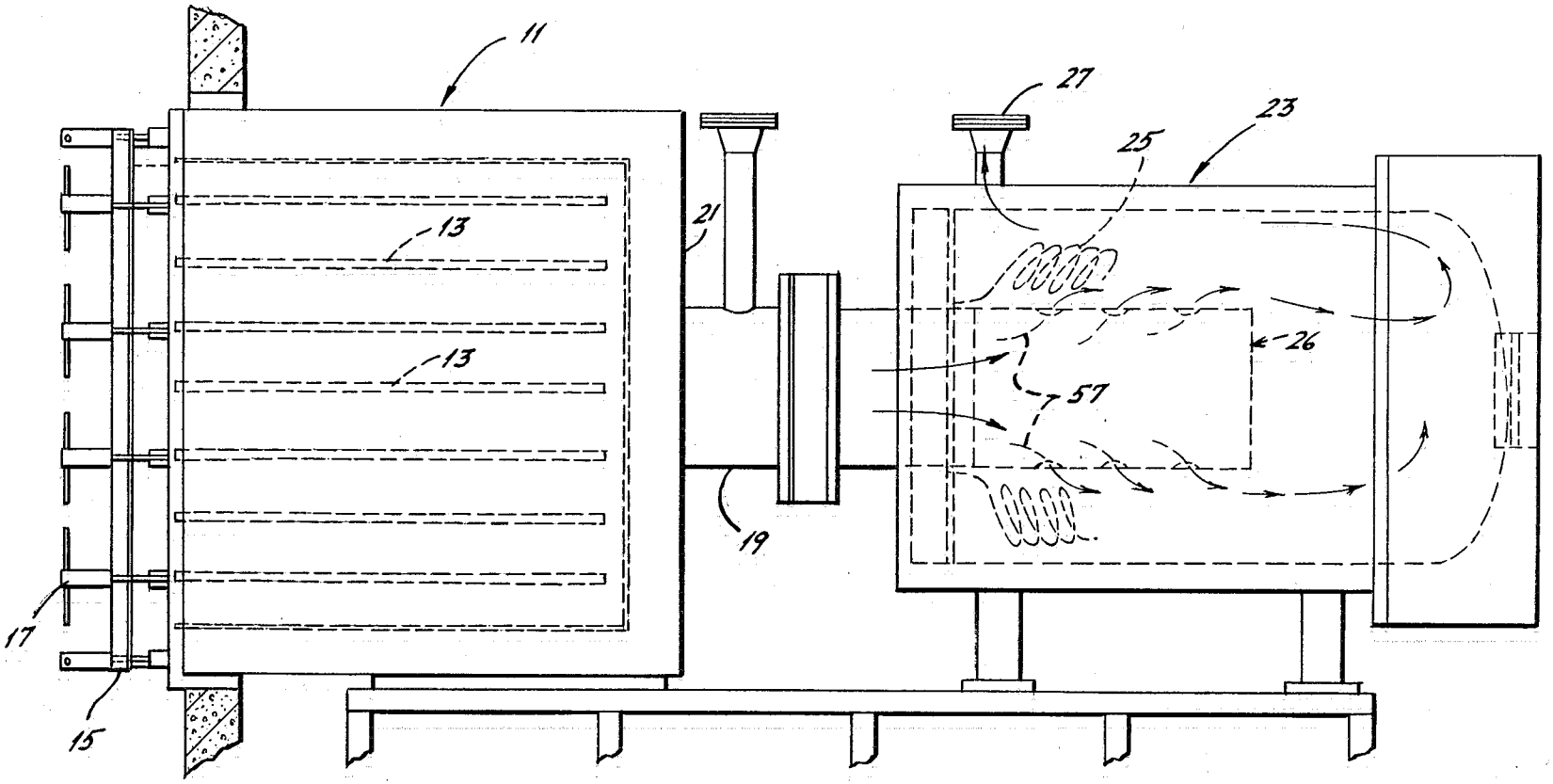
FIG. 1 is a side elevation of a freeze dryer system of the invention showing the product chamber, the condensing chamber and vacuum connection and evacuation duct therebetween.

A batch process freeze dryer system having greatly enhanced evaporation control and improved evacuation of the sublimation generated vapors of evaporation from a product undergoing freeze dry (lyophilization) processing. The product is held within a product chamber 11, FIG. 1, on any of a plurality of shelves 13 or racks horizontally mounted within the product chamber 11. The product chamber 11 can take any of a plurality of shapes, but has great utility when rectangularly shaped so that the shelves 13 can be mounted to the walls of this chamber 11 and accessed through a door 15. The chamber 11 is built securely and a pressure door 15 having a plurality of rechetable clamps 17 is hinged to open and close the chamber 11 thereby providing access thereinto for removal of product. The chamber is subject to a vacuum with a pressure in the range of 0.1 to 1.0 Torr, this being in the magnitude of 0.1 to 1.0 millimeters of mercury pressure (about 0.00013 to 0.0013 atmospheres).

Product is placed within the product chamber 11 on the open shelves 13 made hollow to accommodate circulated heat transfer fluid, and the product is frozen. Moisture is driven from the product by sublimation because of the very low pressure, almost a complete vacuum, created within the product chamber 11 once it is sealed. A large evacuation duct 19 opens into the back wall 21 thereof. This large evacuation duct 19 feeds into a condensation chamber 23 located at a point away from the product chamber 11. The duct 19 opens onto a diffuser 26 containing a plurality of holes. The diffuser 26 opens onto a plurality of refrigerant coils 25 positioned within the condensation chamber 23 and surrounding the diffuser 26. These refrigeration coils 25 trap the water or other sublimation vapor evaporated from product held within the product chamber 11, whereby this vapor condenses on the coils 25. A flow of inert gas 57 passes over the refrigerant coils 25 and then travels to an exit port 27 on which a vacuum is applied. This port is on top of the condensation chamber 23, but does not necessarily have to be placed at this location. It can be placed anywhere within the condensation chamber 23 to provide a negative pressure on the product chamber 11 thereby drawing off the vapors of evaporation from the product held therein and condensing the vapors on the refrigerant coils 25. The structure above described as the product chamber 11, shelves 13, door 15, clamps 17, duct 19, back wall 21, condensation chamber 23, refrigerant coils 25 and diffuser 26 are shown in U.S. Pat. No. 3,381,746.

Figure 2:
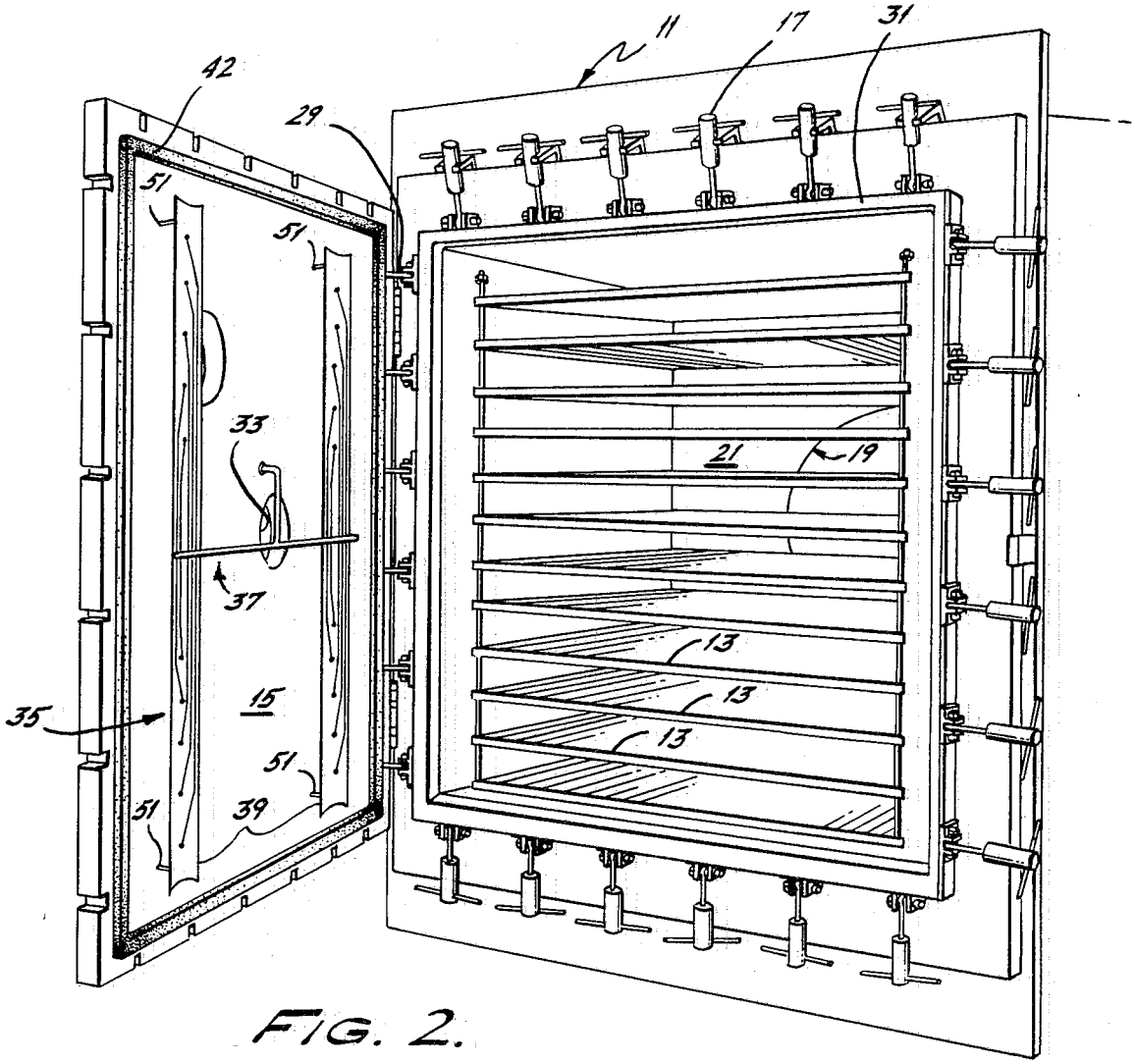
FIG. 2 is a perspective view of the product chamber with its access door open and the gas distribution manifold piping visible.

The access door 15 is hinge mounted with hinges 29 to the product chamber 11, FIG. 2. A plurality of the clamps 17 on the chamber 11 completely surround a seating flange 31 which is used to seal the door 15 against the product chamber 11 when mated with a bullet nose gasket 42 on the door 15, which gasket 42 is made of a polymer material. While the evacuation duct 19 opening in the back wall 21 of the product chamber 11 is very large, it does not cover the entire rear wall 21 of the product chamber.

The shelves 13 are hollow with a serpentine pattern for flow of temperature controlled heat transfer fluid for supplying heat energy to the product, principally by convection, to replace that heat energy which is lost due to evaporitive cooling effect on the subliming product. The spacing between these shelves 13 is sufficient to hold the product containers intended to be used within the freeze dried system and for a circulation above each container.

The door 15, FIG. 2, carries on it a pressure sustaining viewing port 33 and a manifold distribution system 35. This manifold distribution system includes manifold piping 37 and a pair of baffles 39.

The manifold distribution system 35 is mounted to the inside face of the door 15 and is held in position by a ½ inch stainless steel high strength pipe 41 which passes through the door 15 to access the interior of the product chamber 11 at a "through-point" 43 which is welded or brazed or otherwise gasketed to seal against pressure. A pair of stand offs 51 act as supports and steadying feet for each baffle 39. These supports can be glued, welded or otherwise secured to the door 15, but need not be so.

Figure 3:
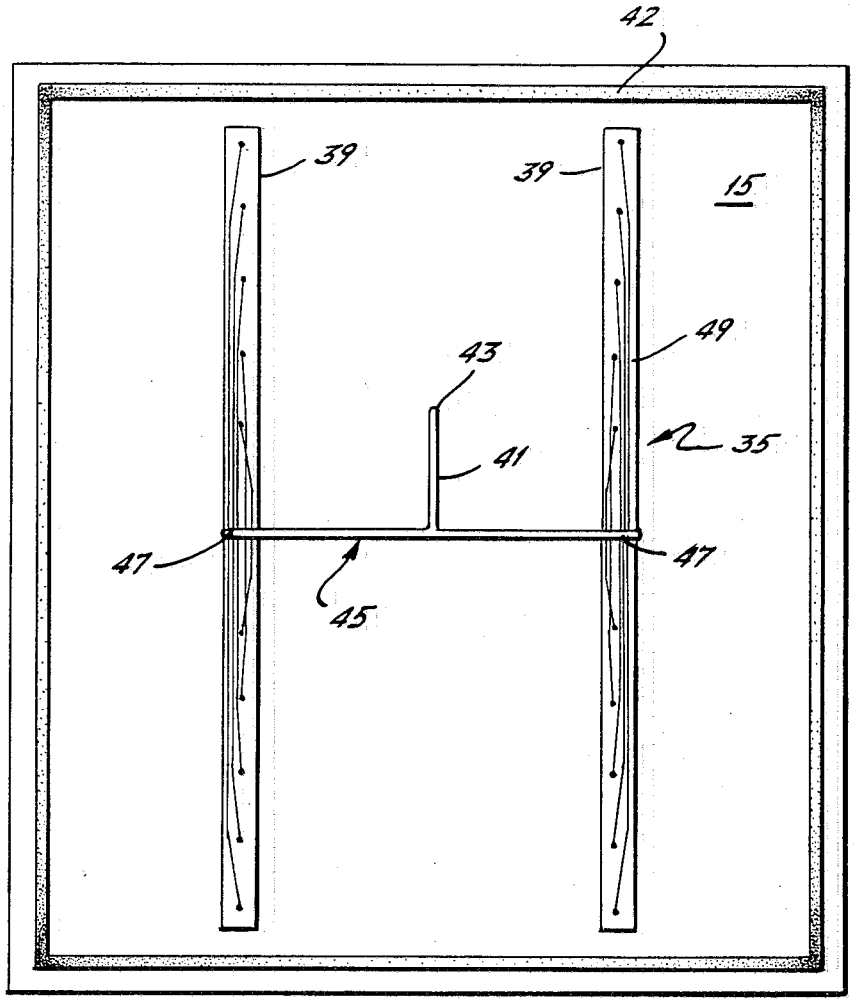
FIG. 3 is a face view of the inside of the access door shown in FIG. 2, showing manifold piping.

The stainless steel pipe 41, FIG. 3, is ½ inch outside diameter and has a tee cross section which extends horizontally after the pipe 41 drops down vertically having passed through the through point 43. This horizontal section 45 extends in both directions along the face of the door 15 at an equal distance from the down tube or down pipe 41 position, and a distance equal to about half the width of the door 15 so that each end point 47 of the horizontal section 45 of the stainless steel pipe is positioned to terminate in a plug or closed off end at a distance from the edge of the door 15 equal to about ¼ to ⅓ of the width of the door 15. The horizontal run 45 is likewise positioned half way between the top and bottom of the door 15.

A plurality of spider-like capillary lines 49, FIG. 3, extend vertically both upwardly and downwardly from a section of each end 47 of the horizontal run 45 of the stainless steel pipe 41. Each capillary line 49 extends directly out of the horizontal pipe 45. However, the extension of each capillary line 49 extends a varying distance to provide a distribution of discharge points. Each capillary line 49 passes through its baffle 39. Each baffle 39 runs vertically along the height of the door 15 and is semicircularly curved.

Figure 4A:
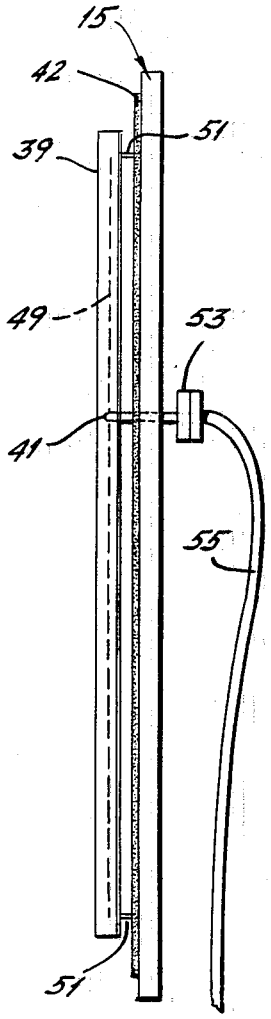
FIG. 4*a* is a side view of the access door shown in FIG. 3.

The stainless steel pipe 41 passes through the door 15 to mate with a coupling 53 on the outside wall of the door 15, FIG. 4*a*. This stainless steel pipe 41 has a very short horizontal run of about ½ to 1 inch long so that the baffle 39, capillary lines 49 and tube 41 portion, as well as, the horizontal leg 45 are spaced about ½ to 1 inch away from the inside of the door 15. This distance can vary, however, with the physical sizing of the system. The baffle 39 is cut from 1½ inch outside diameter pipe to form its semicircular crossectional shape. The baffles 39 can vary in size and arc dimensions depending upon the size of the product chamber 11 with which these are used. Typically, however, this baffle 39 extends almost to the top and bottom edges of the door 15. The line 41 is connected to a coupling 53 on the outside of the door 15. A flexible high pressure or vacuum sustaining line 55 connects the output of a pressure regulation system to the coupling 53. The flexibility of this line 55 allows the door 15 to be easily opened and closed.

Figure 4:
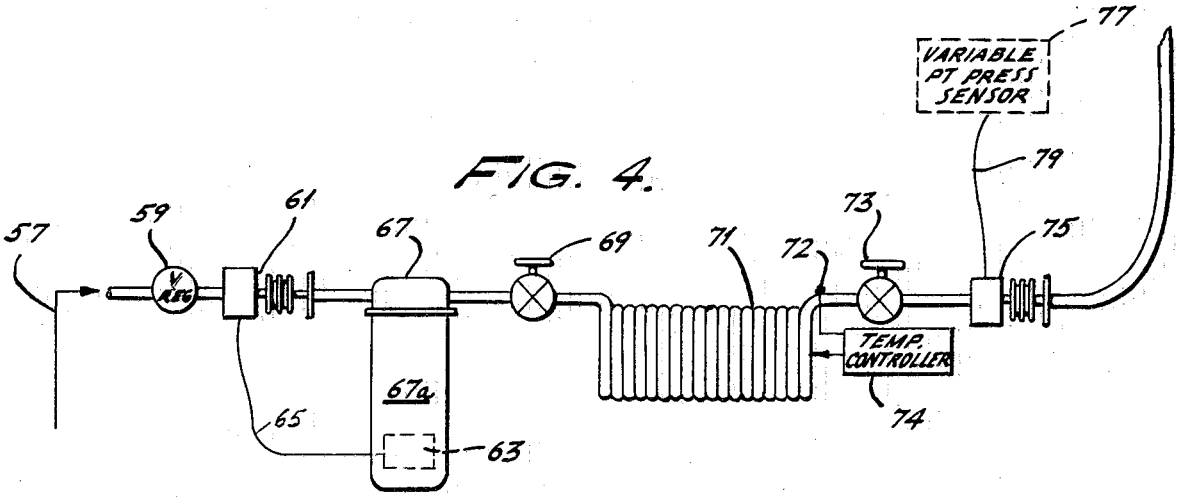
FIG. 4 is a schematic view of the connected pressure regulation control apparatus for supplying carrier gas.

A pressurized supply 57 of inert gas such as nitrogen or argon, FIG. 4, is connected to a pressure regulation system through connection to a first pressure regulator 59. This pressure regulator is mechanically calibrated to provide an output pressure of about 1 psig. The downstream side of this first pressure regulator 59 is connected to a solenoid valve 61. This solenoid valve 61 receives electrical signals via electrical cabling 65 from a pressure sensor 63 located within a downstream acculator chamber 67*a*. The solenoid valve 61 cuts off the supply at the output of the pressure regulator 59 as a function of the pressure sensed within predetermined limits of 1–10 millimeters of mercury.

Connected to the downstream side of the solenoid valve 61 is an accumulator 67 having the accumulator chamber or cannister 67*a*. The capacity of this accumulator 67 is adjustable by adjusting the size of the cannister 67*a*. The accumulator is intended to act as a dampener to smooth out changes in pressure in the system.

The downstream side of the accumulator chamber 67 is connected to a metering valve 69 which acts as an expansion valve providing a second stage of pressure or flow control for the carrier gas 57. The metering valve 69 is set so that its output pressure is from 0.1 to 1.0 millimeters of mercury. The valve 69 output then passes to a heat transfer coil 71. This heat transfer coil 71 acts as a second stage accumulator. A temperature controller 74 provides heat or cooling as needed to the coil 71. This temperature controller 74 is controlled by and connected to a thermocouple 72 on the downstream side of the transfer coil 71. The arrangement is set to keep the temperature of the gas 57 at the output of the coil 71 at about 21° C.±1° C.

A second metering valve 73 is connected to the downstream end of the heat transfer coil 71. This second metering valve 73 acts as a flow control expansion valve after the heating (usually) of the carrier gas in the coil 71 to reestablish a pressure of 0.1 to 1.0 millimeters of mercury in the line. This valve 73 provides third stage pressure control and is mechanically adjustable. A second solenoid valve 75 is electrically operated from a variable set point pressure sensor 77 positioned within the product chamber 11. Electrical control cables 79 connect the variable set point pressure sensor 77 with the solenoid valve 75. The variable set point pressure sensor 77 can be located midway between the door 15 and the evacuation duct 19 to provide an average reading.

This pressure regulation and control system, FIG. 4, operates in conjunction with the vacuum draw at the evacuation duct 19 to feed very low pressures of the carrier gas 57 through the product chamber 11, the pressure with the chamber 11 is thereby kept within the range of from 0.1 to 1.0 millimeters of mercury. When the carrier gas 57 is discharged into the chamber 11 it is at the same pressure as that chamber so that there is no expansion and resultant cooling of the gas 57 upon discharge into the chamber.

Figure 5:
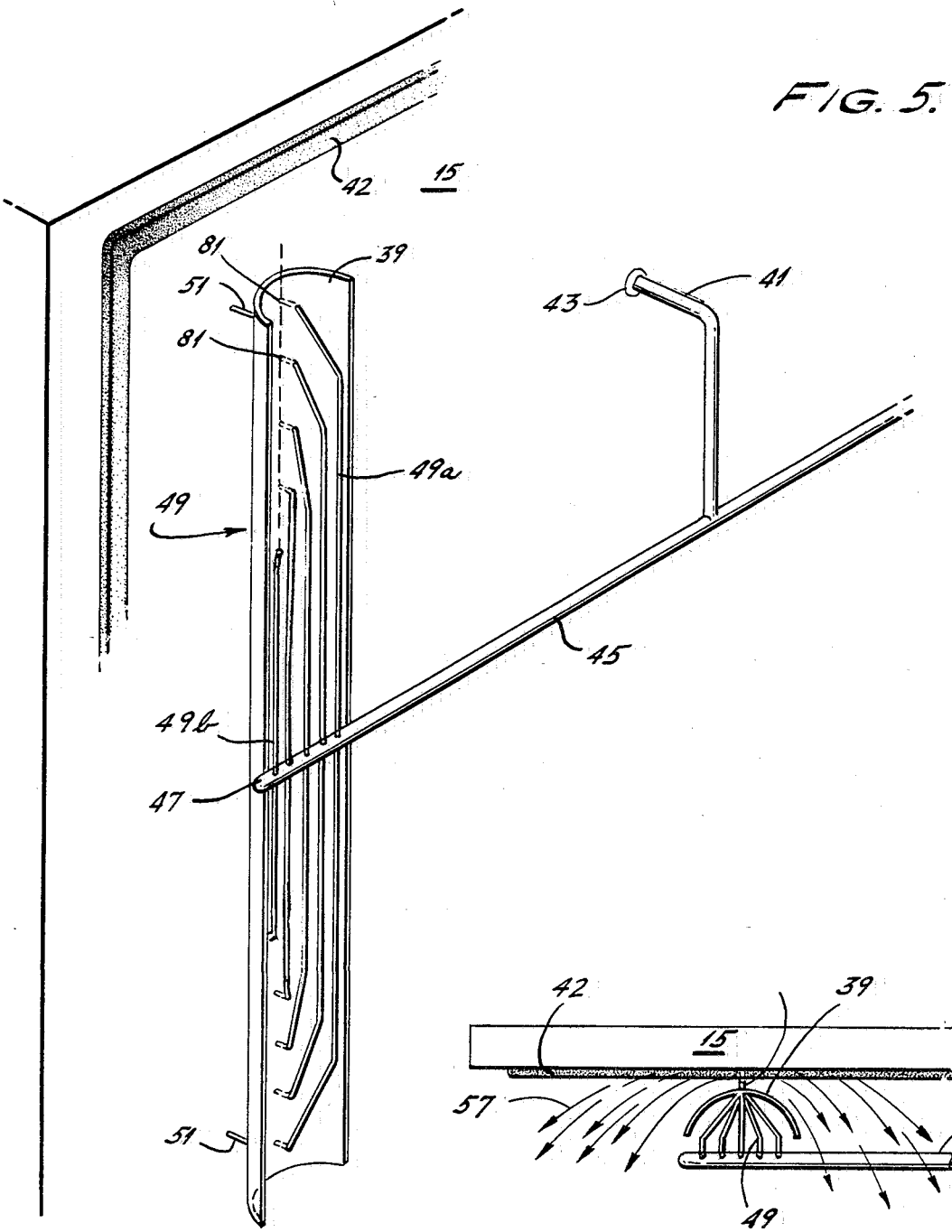
FIG. 5 is a detailed partial perspective view of the manifold piping.

FIG. 5 shows the distribution system, i.e. the manifold piping in greater detail. The door 15 contains a through point 43 which is sealed by welding, brazing or gasketing about the stainless steel pipe 41 which contains a horizontal run into the product chamber 11 and away from the inside face of the door 15, a distance of about ½ to 1 inches as previously stated. This stainless steel pipe 41 then turns downwardly to run vertically downwardly a distance of about 1 to 4 inches. This downward run is not necessary if the through point 43 is in the middle of the door 15 and is only necessitated because a commercially available door 15 is being used and a normal port 43 appears in this door 15 about 2 to 4 inches above the actual middle of the door 15. The horizontal leg 45 extends outwardly toward the side edge of the door 15 from the vertically downwardly run of the stainless steel pipe 41. A silver solder plug 47 is brazed into this horizontal leg 45 to close the end and to cause the horizontal leg 45 to form a manifold or supply line. The plurality of spider-leg capillary lines 49 are connected to the horizontal supply leg 45 with the longest capillary line 49*a* at the upstream end of the leg 45 and the shortest capillary line 49*b* at the far end or lowest pressure end of the supply leg 45 next to the plug 47. There can be one capillary line 49 for each shelf 13 in the product chamber 11 with approximately one half of these discharging above the horizontal leg 45 and the others below. This number of capillary lines 49, i.e. one for each shelf 13, can be deviated from. The length of each capillary line 49 is "tuned" according to its "tap" discharge position on the horizontal supply leg 45, so that the flow of the carrier gas 57 exiting each capillary line 49 is held approximately equal.

Each baffle 39 is semicircular in shape and can be made from stainless steel sheet or other high strength and reasonably corrosive resistant material. Each baffle 39 extends the length of the expanse of the capillary lines 49, and each capillary line 49 extends through a drilled hole in the baffle at the apex of the arc of the baffle 39 curve. These holes 81, FIG. 5, have been drilled through the baffle 39 for each capillary line 49 along a longitudinal center line. The capillary lines 49 are welded to the baffle 39 and act to steady or otherwise support the baffle 39.

Figure 6:
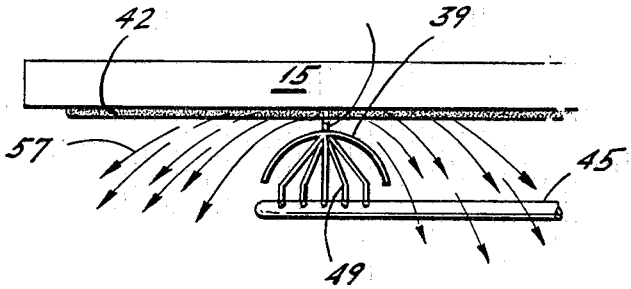
FIG. 6 is a partial top view of the manifold piping of FIG. 5.

The flow of carrier gas 57 exiting each of the capillary lines 49 is directed toward the inside face of the door 15, wherein it is forced to change direction to flow around baffle 39, FIG. 6. In this manner, not only do the capillary lines 49 act as diffusers, but the combination of the gas 57 flow bouncing off the inside face of the door 15 and traveling around the baffle 39 further promotes a more even dispersal of carrier gas 57 along the entire width of each of the shelves 13 at a distance above each shelf 13 to flow above the tops of any open beakers or containers positioned thereon.

Figure 7:
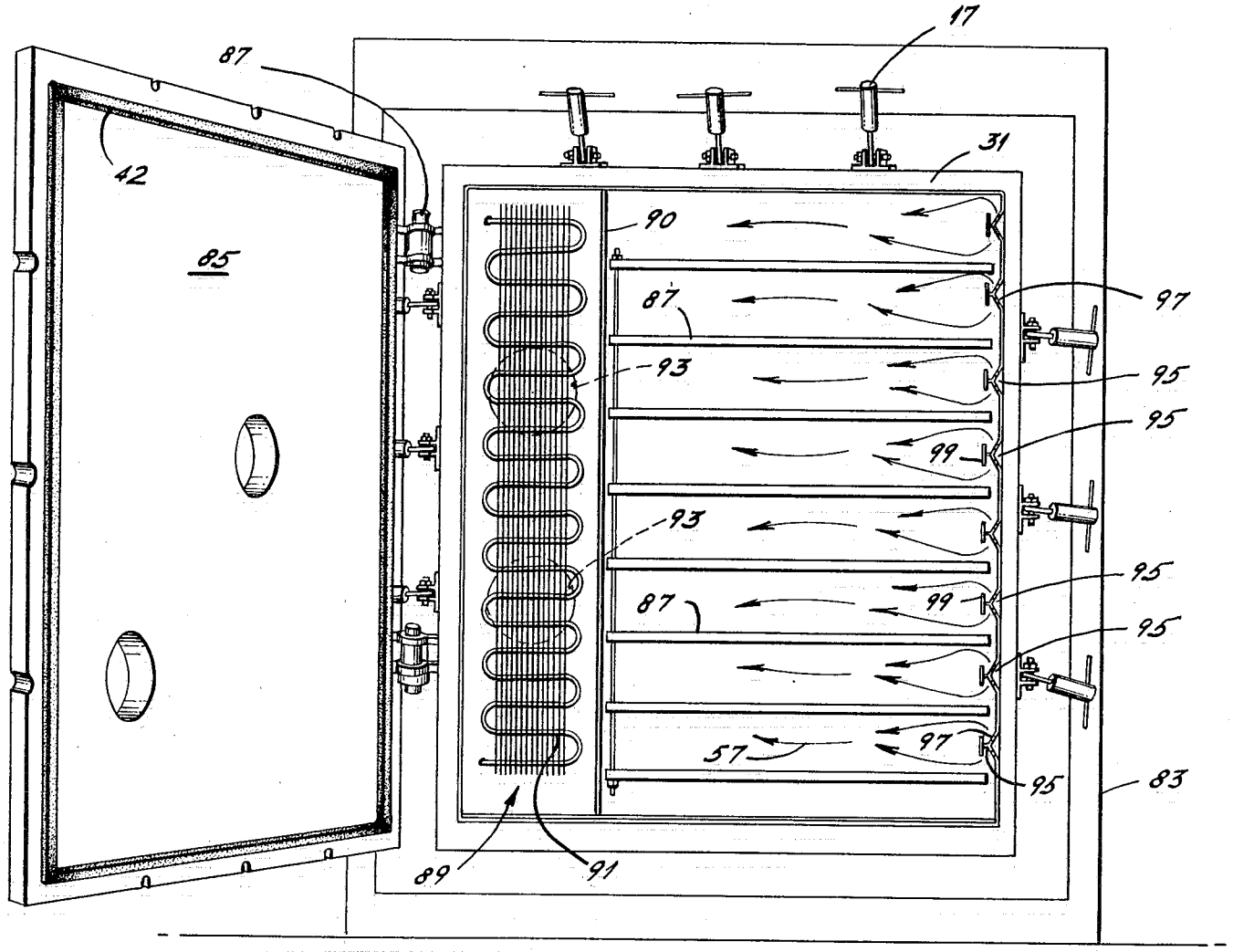
FIG. 7 is a perspective view of an alternate embodiment for the manifold piping, the product chamber and the condensation chamber of FIGS. 1 and 3–6.

The freeze dry apparatus shown in FIGS. 1 through 6 discussed above provides a structure for the subliminal evaporation of frozen product held within the product chamber 11. It provides an enhancement whereby the flow of the inert gas 57 is directed more uniformly above each product container whereby this flow helps carry away the vapors arising from the product thereby reducing the partial pressure of those vapors above each product container and promoting faster evaporation. The even distribution of the carrier gas 57 above a container assures that the evaporation process carried out for each container, regardless of its location within the product chamber 11, or its position on any of the shelves 13, is reasonably uniform for each product container within the chamber 11. The pressure regulation assures that excessive carrier gas pressures do not build up within the product chamber 11 which excessive pressures would naturally inhibit the sublimination process. Alternative structures can be envisioned which would accomplish the same process as discussed above and would be within the intent and scope of this invention. Such an alternative structure is shown in FIG. 7.

In this embodiment, the product chamber 83 has a door 85 mounted to the product chamber 83 via a plurality of hinges 87. As with the other embodiment, a plurality of clamps 17 are used to seal the door 85 against a seating flange to close off the access door 85 to the product chamber 83. The door 85 carries a bullet nose gasket 42. Positioned within the product chamber 83 is a plurality of shelves 87. These shelves 87, however, do not extend completely across the product chamber 83 but terminate at a condenser compartment 89. A thermal radiant shield 90 containing a plurality of openings to allow passage of gas and vapors extends vertically within the product chamber 83 and forms the separation wall between the shelve 87 area and the condenser compartment 89.

A serpentine condenser coil 91 carries a refrigerant and this coil 91 completely fills the condenser compartment 89 and the coil 91 extends from top to bottom. A pair of vapor outlets 93 are each positioned about a third of the distance along the condenser compartment 89 from top to bottom.

A manifold system comprising a plurality of manifold ducts 95 is positioned along the side wall of the product chamber 83 opposite and away from the condenser compartment 89. These manifold ducts 95 are positioned, one each above a respective one of the shelves 87 and contain a plurality of fine diffuser openings or holes 97 through which the carrier gas 57 passes. A plurality of baffle plates 99 are positioned within the product chamber 83 with one baffle 99 being located adjacent to an individual one of the ducts 95 so as to dispense the streams of carrier gas 57 discharging from the holes 97.

Figure 8:
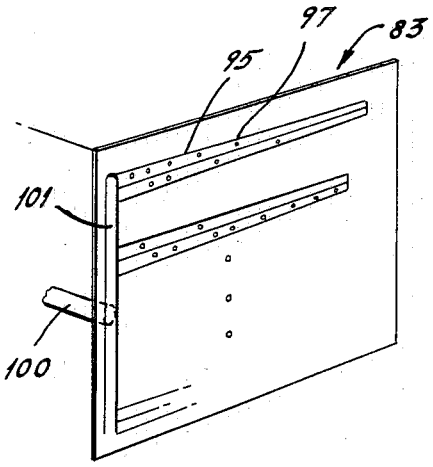
FIG. 8 is a partial perspective view of the distribution manifold piping for the embodiment of FIG. 7.
Figure 9:
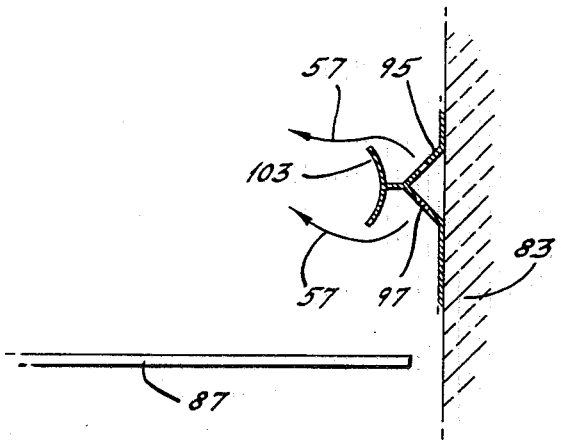
FIG. 9 is a partial crossection of a different baffle plate arrangement for the distribution manifold piping of FIG. 7.

The manifold ducts 95 feed off a distribution pipe 101, FIG. 8, which approximates the function of the horizontal run pipe 45. The distribution pipe 101 is fed from a feed pipe 100 which approximates the function of the pipe 41 of the other embodiment. The ducts 95 can be fabricated of sheet metal in a triangular cross-sectional shape and can extend horizontally along the depth of the side wall of the product chamber 83, FIGS. 8, 9. The size, position and number of the diffuser holes 97 can be adjusted so the pressure of the carrier gas 57 exiting above any particular shelf 87 is relatively uniform along the length of that shelf 87 and for each of the shelves 87. The position of each manifold duct 95, FIG. 9, above a respective shelf 87 is determinative of the product holding beaker's size which can be used within the product chamber 83. A baffle 103, FIG. 9, is a curved plate welded to the apex of each manifold duct 95 and positioned to stand slightly away from these ducts. This baffle 103 promotes the more even diffusion of the carrier gas 57 exiting from the holes 97 in the manifold ducts 95. This baffle 103 can be a straight plate 99 as shown in FIG. 7. The shape will alter the resultant baffling.

Typically, all of the structure described above can be made of type 304 stainless steel or other non reactive material. It is essential that none of the building materials give off gases or add particulate matter to the carrier gas 57 or the environment within the product chambers 11, 83.

Many changes can be made in the above described invention without departing from the intent or scope thereof. It is intended therefore that the above description be read as illustrative of the invention and that the invention not be limited expressly thereto.

What is claimed is:

1. An improved method of freeze drying product through sublimation including the steps of:

storing frozen product to undergo lyophilization in a sealable product chamber;

subjecting said product chamber to continuous evacuation through a duct connected thereto whereby a very low atmosphere approaching a vacuum is maintained within said chamber; and introducing small amounts of an inert gas from a supply source into said product chamber at a location opposite said evacuation duct to promote a flow across said product chamber thereby promoting flow of lyophilization vapors;

wherein the improved method comprises: regulating said introduction of inert gas by a first pressure regulating of said inert gas to approximately 1 psig. from said source of said inert gas;

a second pressure regulating of said inert gas to approximately 1–10 millimeters of mercury pressure following said first regulation;

a third pressure regulating of said inert gas to approximately 0.1–1.0 millimeters of mercury pressure following said second regulation; and introducing said inert gas into said chamber following said third regulation and distributing the flow of said gas once introduced into said product chamber to promote an even and uniform flow to all areas of said product chamber.

2. The method of claim 1 also including the step of accumulating a volume of said inert gas after said first pressure regulation step and before said second pressure regulation step.

3. The method of claim 2 also including the step of heating said inert gas to approximately 21° C. after said second pressure regulation step and before said third pressure regulation step.

4. The method of claim 3 wherein said first pressure regulation step includes a first monitoring of the pressure of said accumulated volume and cutting off and allowing the flow of inert gas after said first pressure regulation step when said accumulated volume pressure goes outside of the range of 1–10 millimeters of mercury.

5. The method of claim 4 wherein said third pressure regulation step includes a first monitoring of the pressure within said product chamber and cutting off and allowing the flow of inert gas after said third pressure regulation step when the pressure within said product chamber goes outside of the range of 0.1–1.0 millimeters of mercury.

6. The method of claim 5 wherein said first monitoring within said product chamber occurs at a location to give an average pressure reading for said product chamber.

7. The method of claim 1 wherein said distributing step includes piping said introduced inert gas from said introduction location into said chamber within said chamber to a plurality of discharge points at various locations across the width and height of said chamber, each discharge point being at a location in said chamber across from said evacuation duct thereby promoting cross product chamber flow.

8. The method of claim 7 wherein said piping step includes tuning said piping to promote uniform flow rate of said inert gas from each of said various discharge points.

9. The method of claim 8 wherein said inert gas flow is also baffled flowing discharge from each discharge point.

10. A batch process freeze dryer apparatus comprising:

a product chamber containing a plurality of shelves each capable of holding a plurality of open product containers;

a condenser chamber containing refrigeration coils, said condenser chamber being connected directly to said product chamber;

means for producing a vacuum on said condenser chamber and thereby on said product chamber through said condenser chamber connection; and means for introducing minute quantities of an inert gas into said product chamber on a side thereof opposite said condenser chamber connection, said introducing means also including distributing means for discharging gas evenly above each shelf at said introduction side and including a first regulator means capable of being connected to a supply of said inert gas and regulating the flow therefrom;

a first electric valve means connected to the down stream side of said first regulator means and having a first pressure sensor switch connected thereto and positioned at a despirate location to remotely control said valve means;

a second regulator means connected to the downstream side of said first electric valve means and being adjustable for regulating the flow therethrough;

a third regulator means connected to the downstream side of said second regulator means and being adjustable for regulating the flow therethrough; and a second electric valve means connected to the down stream side of said third regulator means and having a variable set point pressure sensor switch positioned within said product chamber to electrically control said second valve means, wherein said second electric valve means output is connected to said distributing means.

11. The apparatus of claim 10 also including a first means for smoothing out pressure changes in said inert gas flow said first smoothing means being connected between said first electric valve means and said second regulator means and having a structure for accumulating a volume of said inert gas, said accumulation structure being said location for said first pressure sensor connected to said first electric valve means.

12. The apparatus of claim 11 also including means for temperature conditioning said inert gas following its flow through said second regulator means.

13. The apparatus of claim 12 wherein said first regulator means is a first pressure regulator being connectible to said inert gas supply; wherein said first electric valve means is a first solenoid valve connected to the downstream side of said first pressure regulator said first solenoid valve being connected to operate upon an electric signal from said first pressure sensor switch, wherein said first pressure smoothing means is an accumulator chamber connected to the downstream side of said first solenoid valve and said accumulation structure is a cannister; wherein said second regulator means is a second pressure regulator connected to the downstream side of said accumulator chamber; wherein said temperature conditioning means is a heat transfer coil connected to the downstream side of said second pressure regulator; wherein said third regulator means is a third pressure regulator connected to the downstream side of said heat transfer coil; and wherein said second electric valve means is a second solenoid valve connected to the downstream side of said third pressure regulator, said second solenoid valve being connected to operate upon an electric signal from said variable set point pressure sensor located midpoint within said product chamber, the output from said second solenoid valve being connected to said distributing means.

14. The apparatus of claim 10 wherein said introducing means is capable of controlling said inert gas pressure within said product chamber to the range of 0.1 to 1.0 millimeters of mercury pressure, and wherein said temperature conditioning means includes a thermocouple located on the outlet of said heat transfer coil and a temperature controller connected to operate as a function of said thermocouple output, said temperature controller being connected to heat and cool said heat transfer coil to approximately 21° C.

15. The apparatus of claim 10 wherein said distributing means includes:

flexible piping connected to said introducing means;

means for carrying said inert gas from said flexible piping into said product chamber;

means for discharging said inert gas into said product chamber from said carrying means at a plurality of separate locations; and means for dispersing said discharged inert gas from each separate location.

16. The apparatus of claim 15 wherein said carrying means is a manifold pipe connected to said flexible piping and passing into said product chamber to at least two distribution points; and wherein said discharging means is a plurality of capillary openings into said product chamber from said manifold pipe, said openings being dispersed over an expanse of said product chamber.

17. The apparatus of claim 16 wherein said dispersing means includes a baffle positioned to alter the stream of inert gas flow from each of said capillary openings.

18. The apparatus of claim 17 wherein said capillary openings include a plurality of spider-like capillary lines extending from said manifold pipe at each distribution point, said capillary lines each providing an opening from said manifold pipe into said product chamber at the end thereof and each being of a different length to provide a dispersal of said capillary line openings throughout said product chamber.

* * * * *